US005557862A

United States Patent [19]

Vetter et al.

[11] Patent Number: 5,557,862

[45] Date of Patent: Sep. 24, 1996

[54] PROCESS AND APPARATUS FOR THE CONTINUOUS HEAT SETTING OF YARN LAID DOWN IN LOOPS

[75] Inventors: Gerhard Vetter, Süssen; Ludwig Resch, Töging, both of Germany

[73] Assignee: M.H. Maschinenfabrik GmbH & Co., KG, Donzdorf, Germany

[21] Appl. No.: 429,157

[22] Filed: Apr. 19, 1995

[30] Foreign Application Priority Data

Apr. 30, 1994 [DE] Germany ..... 44 15 229.9

[51] Int. Cl.[6] ..... F26B 13/00

[52] U.S. Cl. ..... 34/618; 34/625; 34/634; 28/278

[58] Field of Search ..... 34/618, 619, 620, 34/621, 624, 625, 659, 462, 466; 28/278, 279

[56] References Cited

U.S. PATENT DOCUMENTS

| | | | |
|---|---|---|---|
| 2,622,182 | 12/1952 | Forzley et al. | 34/625 |
| 3,039,259 | 6/1962 | Lenoble | 28/278 |
| 3,040,657 | 6/1962 | Ichinose | 34/618 |
| 3,071,917 | 1/1963 | Fisher | 28/278 |
| 3,620,868 | 11/1971 | Burger | 28/101 |
| 3,683,650 | 8/1972 | Hirschburger | 34/625 |
| 3,921,265 | 11/1975 | Eschenbach | 28/101 |
| 3,984,970 | 10/1976 | Terada et al. | 28/278 |
| 4,513,514 | 4/1985 | Steiner . | |
| 5,189,810 | 3/1993 | Vetter | 34/618 |
| 5,232,546 | 6/1994 | Glover et al. | 34/634 |

*Primary Examiner*—John T. Kwon

*Attorney, Agent, or Firm*—Evenson McKeown Edwards & Lenahan, PLLC

[57] ABSTRACT

In the case of a process for the continuous heat setting of yarn, the yarn, laid down in loops on transport belts, is fed through a heat setting chamber which operates with superheated steam and under atmospheric pressure. Because of the entry and exit openings, the temperature inside the heat setting chamber is constant only over a part of the transport length. The chamber temperature is set slightly above the required heat setting temperature. Transport speed and chamber length are so adjusted in relation to each other than the yarn, having reached the heat setting temperature, essentially retains it along a part of the transport length.

16 Claims, 3 Drawing Sheets

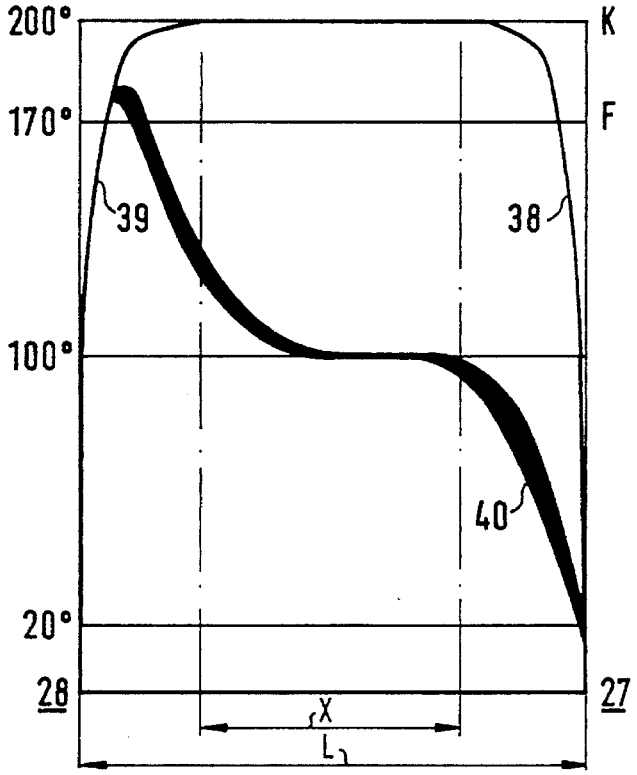
FIG. 5
FIG. 6
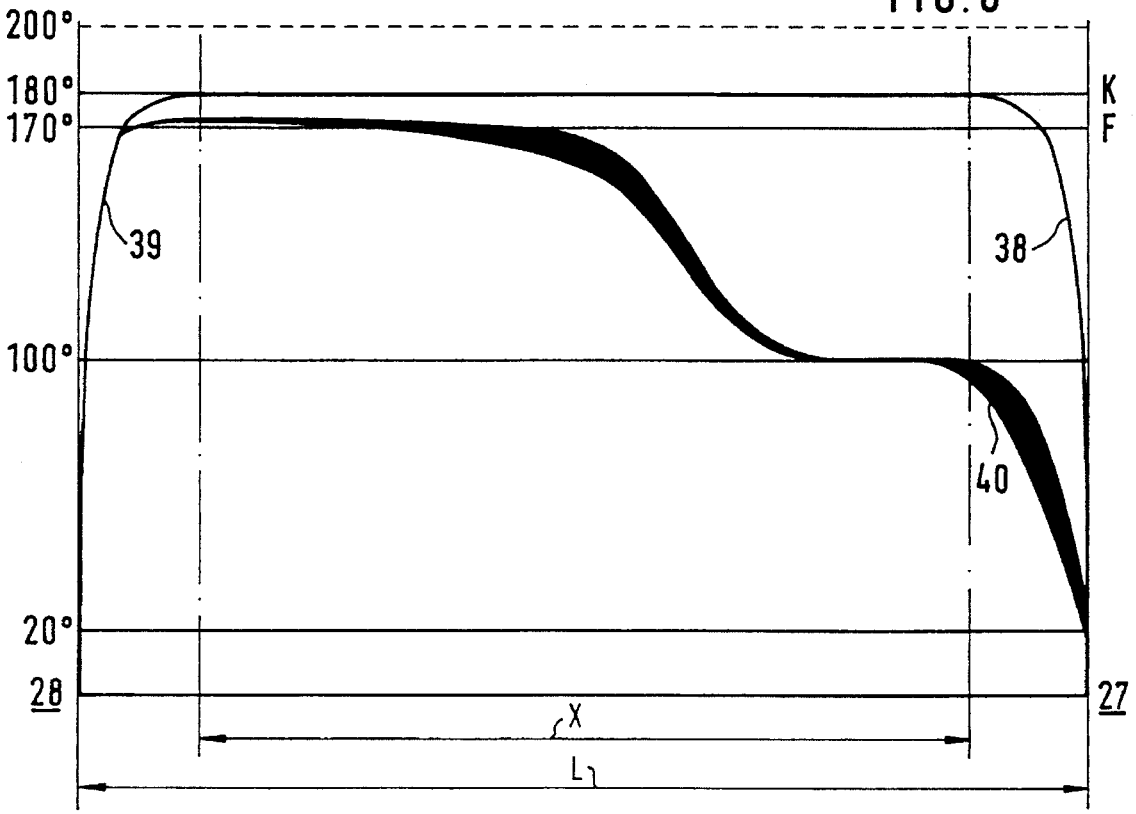

PROCESS AND APPARATUS FOR THE CONTINUOUS HEAT SETTING OF YARN LAID DOWN IN LOOPS

BACKGROUND AND SUMMARY OF THE INVENTION

The invention relates to a process for the continuous heat setting of yarn laid down in loops, which yarn is fed along a transporting section with a predetermined transport speed through a heat setting chamber of predetermined length and operating with superheated steam, in which a chamber temperature prevails which is constant along a part of the transport length and which is set above the required heat setting temperature.

A process of this kind is disclosed in the U.S. Pat. No. 4,513,514. This patent describes an installation for yarn conditioning of the type GVA 2500, which is sold by the firm Maschinenfabrik Michael Hörauf, D-73072 Donzdorf, Federal Republic of Germany, assignee of the present application.

This known process, which is preferably applied for the heat setting of carpet yarns, works in a so-called open system with superheated steam and atmospheric pressure. The temperature in the heat setting chamber lies significantly over that required for heat setting and serves first and foremost the purpose of heating the yarn to be heat set quicker to the heat setting temperature. Due to the yarn being laid down on the transport belts, not all parts of the yarn reach the heat setting temperature simultaneously; some parts of the yarn can thus exceed the heat setting temperature and in certain circumstances be damaged as a result. If, in attempting to exclude the possibility of any damage, the dwell time of the yarn in the heat setting chamber is shortened, it can happen that some parts of the yarn will not reach the required heat setting temperature. In the known process therefore, the individual parameters, namely yarn density, chamber temperature, transport speed, steam content and steam flow rate, must all be exactly observed.

An object of the invention, in the case of a process of the above mentioned type, is a flawless handling of the yarn and thus an avoidance of yarn damage.

This object is achieved in that the chamber temperature is set at a level just above the heat setting temperature,and the transport speed and chamber length are so adjusted that the yarn, having reached the heat setting treatment, essentially retains that temperature for a part of the transport length.

As the chamber temperature lies only minimally over the treatment temperature of the yarn, for example the heat setting temperatures, damage resulting from overheating, which leads to oxidization on the yarn or on the softener, is certainly avoided. The chamber temperature is kept so low that the heat setting temperature, as soon as the yarn has reached it, remains constant for the rest of the dwell time. The chamber extends to a length which guarantees that even yarn parts which do not lie advantageously reach the heat setting temperature. No damage is done when those yarn parts which reach the heat setting temperature earlier remain at this temperature for a while longer, as a harmful excess in temperature is practically impossible.

The process according to the invention has the further advantage that it is not dependent on so many adjusting parameters. Furthermore, energy consumption is reduced because of the lower chamber temperature.

According to the invention, the part of the transport length with a constant chamber temperature is equal to three quarters of the chamber length. As is known, the constancy of the chamber temperature is affected by the entry and exit openings for the transport device, which is led through the heat setting chamber. As a somewhat longer dwell time is now not harmful, the heat setting chamber can be designed to be longer than it has been up to now. This results in a better use of the area with constant temperature, as the part of the chamber length where the chamber temperature sinks due to the entry and exit openings is shorter, in relation to the entire chamber length. For example, if the chamber length is doubled, the length where a constant temperature prevails is trebled. An extended chamber can also be used advantageously in that the transfer density of the loops of the yarns can be reduced, which in turn leads to the critical yarn parts reaching the heat setting temperature quicker.

The chamber temperature is advantageously set at a level which lies at most 10° Celsius above the heat setting temperature. It would be ideal if the heat setting temperature was also the chamber temperature, but this however cannot be attained in practical cases. An effort is made however to keep the chamber temperature as low as possible, so that the yarn just about reaches its heat setting temperature. In this case, it is irrelevant if the dwell time is exceeded by a certain amount; damage to the yarn is practically impossible.

In the case of a heat setting chamber for carrying out the process, which chamber comprises entry and exit openings for the transport belts transporting yarn, a feeding pipe for supplying steam, a heating system for superheating the steam as well as a plurality of fans, arranged beside each other in transport direction, for generating a circulating current of steam and set transversely to the transport direction, more than four fans are provided, of which the two fans arranged nearest the entry and exit openings have a rotational direction which is set against the allocated entry and exit openings. The parts in the heat setting chamber in which the chamber temperature sinks due to the entry and exit openings are kept smaller, thus using the chamber length more advantageously for the heat setting of the yarns.

In a preferred development of the invention the heat setting chamber comprises two single chambers, which are connected to each other by a heat intermediate zone. This leads to a series of advantages. Firstly a standard chamber can be used, which can itself, or in combination with another single chamber, be connected to an extended heat setting chamber. Secondly, the heat setting conditions are easier to control in a reduced single chamber. In addition, when required a process can be executed whereby different temperatures prevail in the two single chambers.

The single chambers have for this purpose the same form and are symmetrically arranged in relation to the intermediate area.

Other objects, advantages and novel features of the present invention will become apparent from the following detailed description of the invention when considered in conjunction with the accompanying drawings.

BRIEF DESCRIPTION OF THE DRAWINGS

FIG. 5 shows a diagram with reference to the temperatures in a known process; and FIG. 6 shows a diagram of the temperatures during the process of the invention.

DETAILED DESCRIPTION OF THE DRAWINGS

Figure 1:
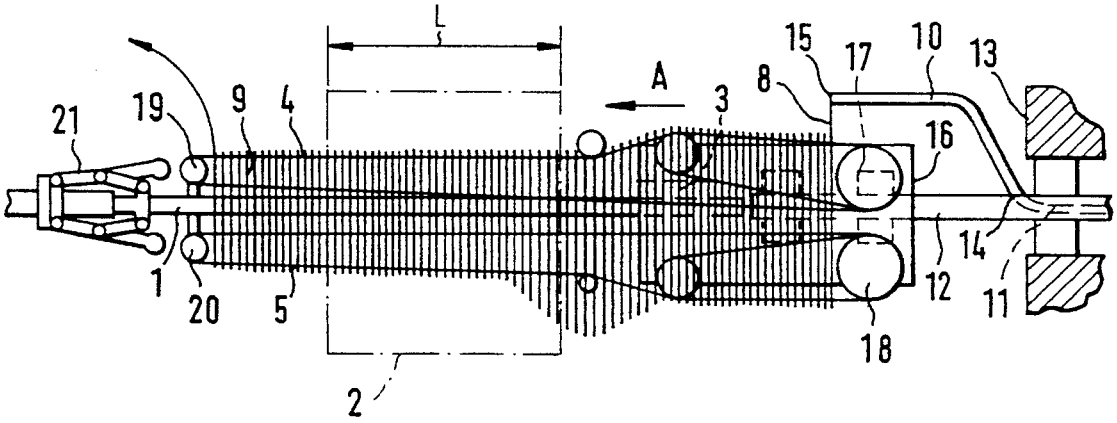
FIG. 1 is a schematic side view of a transport device of a yarn heat setting installation with a heat setting chamber only schematically indicated.

The yarn heat setting installation according to FIG. 1 comprises a so-called central mast 1, which is a component of the transport device and is led through a heat setting chamber 2 (indicated by only a dot-dash line) of the chamber length L. The central mast 1 is supported at one end in a supporting device 3 and at the other end either projects cantilever-wise or is in addition supported from below by a supporting arrangement (not shown). In the case of a practical yarn heat setting installation, a plurality of masts are preferably arranged beside each other; this will be seen later in FIG. 4.

Each central mast 1 is equipped with a plurality of preferably four, transport belts 4, 5, 6 and 7 (compare FIG. 4), of which only two transport belts 4 and 5 are visible in FIG. 1. These transport belts 4 to 7 are arranged in a polygonal pattern or form around the central mast 1, as will be clearly seen from FIG. 4 to be described later. They serve to transport at least one yarn 8, which is wound around the central mast 1 and the transport belts 4 to 7 in the form of loops 9. The point of this arrangement is to allow as large an amount as possible of yarn 8 with predetermined dwell time to be transported continuously through the heat setting chamber 2.

The depositing of the loops 9 takes place by means of a winding flyer 10, which is arranged in the area of the supported end of the central mast 1. The winding flyer 10 beings in a shaft 12 provided with an axial bore hole 11, the shaft 12 being supported in a housing 13 coaxial to the central mast 1. The axial bore hole 11 leads into a radial opening 14 of the shaft 12 and is continued by the crank-like formed hollow winding flyer 10, which, together with the shaft 12, is driven to rotate. The yarn 8 to be transported (the yarn can be a plurality of threads joined together) is fed through the axial bore hole 11 in transport direction A and exits out of the mouth 15 of the winding flyer 10. Due to the rotation of the winding flyer 10, the yarn 8 is wound around the transport belts 4 to 7, the transport belts preferably each having a round cross section.

A gear housing 16 is supported on the shaft 12, which housing 16 does not rotate with the shaft 12 because of certain means which are not shown here but are known in general, and which contains the belt drive for the transport belts 4 to 7. The supporting device 3 already mentioned for the supported end of the central mast 1 is installed in this housing 16.

There are driven upper and lower guide pulleys 17 and 18 for the transport belts 4 to 7 on the gear housing 16. In the area of the end of the central mast 1 which projects cantilever-wise, freely rotatable upper and lower guide pulleys 19 and 20 for the transport belts 4 to 7 are allocated to said guide pulleys 17 and 18. Shortly before reaching these guide pulleys 19 and 20, the loops 9 of the yarn 8 are straightened out, drawn off and fed to a take-up winder in a way not shown here. The guide pulleys 19 and 20 are adjustably supported with respect to the distance between them by means of a tensioning device 21.

Before reaching the heat setting chamber 2, the polygonal-shaped arrangement of the transport belts 4 to 7 becomes smaller by means of tensioning pulleys or similar guides, so that the subsequent shrinking of the yarn 8 in the heat setting chamber is taken into consideration. Because of this, it is indicated in FIG. 1 that the loops 9, in the inlet area of the heat setting chamber 2 temporarily hang down freely from the lower transport belts 5 and 6 and only after a while inside the heat setting chamber 2 shrink in such a way that they again lie around the transport belts 4 to 7.

Figure 2:
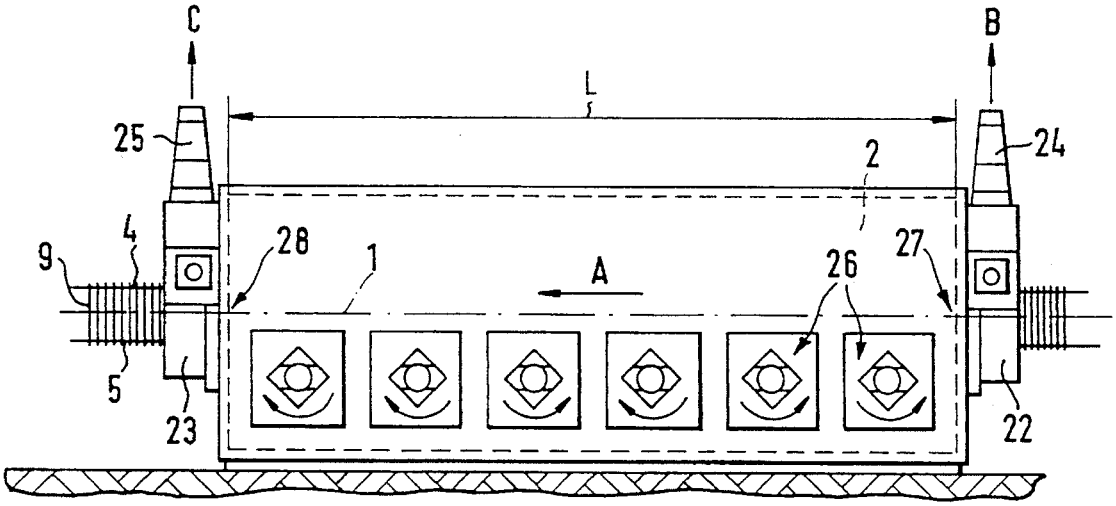
FIG. 2 shows a side view from the outside onto a heat setting chamber constructed according to the invention.

In FIG. 2 which shows a side view of a heat setting chamber 2 from the outside, a central mast 1 is only indicated by a dot-dash line. It is arranged horizontally; the transport direction of the yarn 8 extends accordingly in arrow direction A.

The interior of the heat setting chamber 2 has a chamber temperature K and a chamber Length L. Outside of the actual heat setting chamber 2 there is a pre-entry zone 22 in the entry area, and a pre-exit zone 23 in the exit area. The pre-entry zone 22 and the pre-exit zone 23 serve to seal the heat setting chamber 2 better in the longitudinal direction at those places where the transport belts 4 to 7 are fed in and fed out. At the pre-entry zone 22 and the pre-exit zone 23, a connecting outlet 24 or 25 is arranged, at which a part of the heat setting means, consisting of superheated steam and air, is sucked off accordingly in arrow direction B or C.

Figure 4:
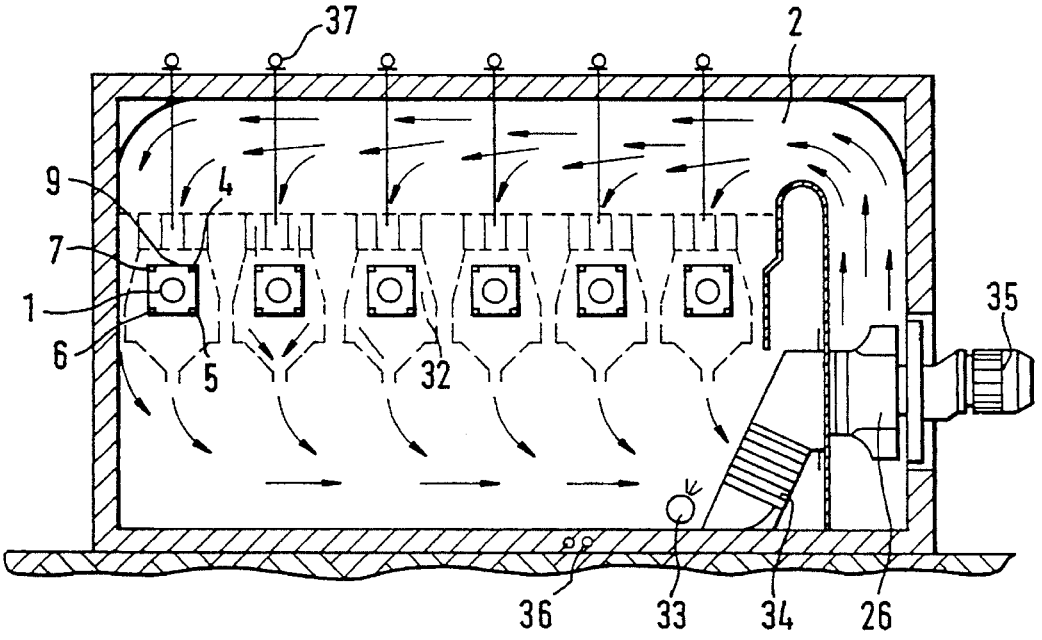
FIG. 4 shows a cross section of the heat setting chamber according to preferred embodiments of the invention.

In the heat setting chamber 2, a circulating current is generated, which will be described later with the aid of FIG. 4, and to which six fans 26 are arranged. These fans 26 have different running directions, as indicated by the arrows. It can be seen that the two fans 26 which are nearest the pre-entry zone 22 have a rotational direction which is directed so that they blow against the entry opening 27 of the central mast 1 in the heat setting chamber 2.

Accordingly, the two fans 26 which are nearest the exit opening 28 of the central mast 1 have a rotational direction which is directed against the exit opening 28.

Figure 3:
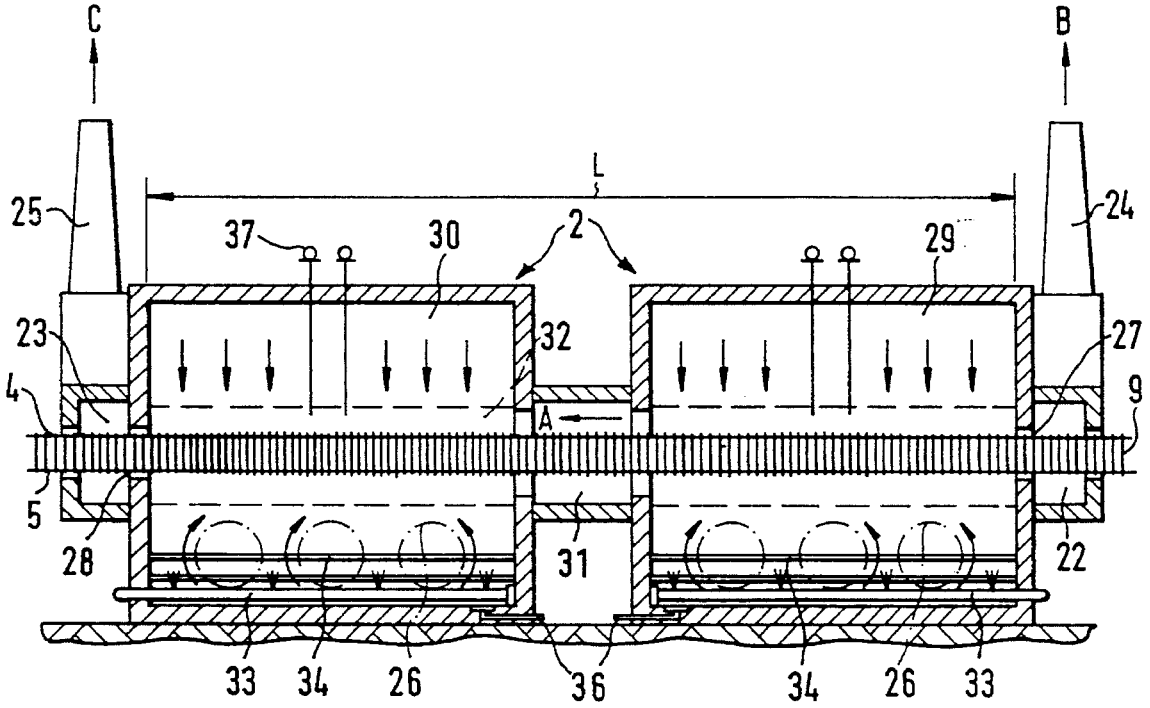
FIG. 3 shows a longitudinal section of another embodiment of the heat setting chamber according to the invention.

The embodiment according to FIG. 3 differs from that in FIG. 2 in that the heat setting chamber 2 comprises two similar single chambers 29 and 30 of the overall chamber length L. The two single chambers 29 and 30 are connected by a heated intermediary zone 31. The single chamber 29 and 30 are so arranged that each is symmetrical with respect to the individual pipelines, etc.

Components which are identical in the embodiments according to FIGS. 2 and 3 have the same reference numbers. Such components occurring in FIG. 3 will not be described again. It should be mentioned that the cross section drawing in FIG. 4 applies to FIG. 2 and FIG. 3.

Each single chamber 29 and 30 comprises three fans 26 whose direction is the same as that already described in FIG. 2.

For each central mast 1 in the inside of the heat setting chamber 2, there is a so-called trapezoidal channel 32 whose cross section is trapezoidal in form; the trapezoidal channel 32 consists mainly of perforated sheet metal which surrounds the transport belts 4 to 7. A so-called three-way ventilation is thus achieved for the loops 9 of the yarns 8.

A feed pipe 33 is located inside the heat setting chamber 2 (or the single chambers 29 and 30) to backfeed steam. The feed pipe 33 extends in longitudinal direction of the heat setting chamber 2, an is located below the transport belts 4 to 7 and extends near to an electric heating system 34 which superheats the steam to the required chamber temperature K. The superheated steam is forced into a circulating current, as indicated by the many arrows, by means of the driven fans 26, each driven by a motor 35. The steam current streams, from above, through the loops 9 of the yarns 8 carried by the transport belts 4 to 7, whereby guiding devices are allocated to the individual central masts 1 for the circulating current. The guiding devices are known from the above mentioned prior art and need not be described in detail here.

A condensation drainer 36 is allocated to the heat setting chamber 2 in its floor area. A plurality of temperature probes 37 are inserted from above into the heat setting chamber 2, with which the heat setting temperature F in the area of the loops 9 of the yarns can be measure.

With the aid of FIGS. 5 and 6 the nature of the invention will be explained in more detail in the following:

FIG. 5, explained first, refers to the above mentioned prior art. The heat setting chamber mentioned here has a chamber length L of approximately 2.5 m. Inside the heat setting chamber 2 a chamber temperature K of, for example, 220° C. prevails, which is considerably more than the heat setting temperature F of 170° C., for example for the yarns 8.

According to FIG. 5, the temperature is outlined along the length L of the chamber, whereby the entry opening 27 is located at the right hand end of the diagram and the exit opening 28 is located at the left hand end of the diagram. It can be seen that the chamber temperature K is constant only along a part X of the transport length, and shows a marked temperature drop 38 or 39 towards the entry opening 27 and the exit opening 28 respectively. In practical embodiments of the heat setting chamber 2, approximately 600 mm are lost in the area of the entry opening 27 and the exit opening 28 in which the chamber temperature K is no longer constant.

The curve 40, drawn with the relatively wide line thickness or range, illustrates the actual temperature at the yarn 8 to be treated. The range arises due to the fact that the laying down of the loops 9 on the transport belts 4 to 7 results in individual spots of the yarn 8 approaching the chamber temperature K at different times.

In the case of the known heat setting chamber 2, there is, as can be seen from FIG. 5, a relatively large temperature reserve between the chamber temperature and the required heat setting temperature F for the yarn 8. This reserve serves to ensure that the yarns 8 reach the heat setting temperature F, even at their most inaccessible places. The danger exists however that other places of the yarn 8 will exceed the desired heat setting temperature F, which can lead to yarn damage in certain cases. For this reason, as mentioned above, several parameters must function exactly concurrently, so that the heat setting temperature F actually is set in the desired way. The dwell time, that is, the time that the yarn 8 is inside the heat setting chamber, must be exactly observed in the known process.

The invention, which will now be explained with the aid of FIG. 6, operates differently. On the one hand, the chamber temperature K lies only slightly over the desired heat setting temperature F, in the depicted example only by 10° Celsius. On the other hand the chamber length L is markedly increased, so that despite the reduced chamber temperature K, the yarn 8 reaches, with certainty, the desire heat setting temperature F, even at its most critical places. As the yarn practically cannot exceed the heat setting temperature F - due to the relatively low chamber temperature K -, in contrast to the known process, it is not harmful when the dwell time is increased. Those yarn areas, which have already reached the heat setting temperature F, remain at this temperature a little longer than the other yarn areas which attain this temperature a little later. It is now irrelevant whether the dwell time is two minutes or four minutes. In the case of the heat setting of carpet yarns, all areas of the loops 9 are thus with certainty completely heat set, without other yarn areas being damaged as a result of an excess in temperature.

As a comparison of FIGS. 5 and 6 show, the relative length of those transport lengths, where the temperature drop 38 or 39 occurs, is relatively less, relative to the chamber length L, in the embodiment of FIG. 6. In the case of the known chamber length of 2.5 m, the part area X with the constant chamber temperature K is approximately 1,300 mm long, while this area X, in the case of a chamber length L of 5 m, would have a length of 4,100 mm. A doubling of the length of the chamber length L leads thus to practically trebling the part area X with a constant chamber temperature K.

The invention can be used to reduce the transfer density of the loops 9 on their transport belts 4 to 7, whereby the yarns 8 are heated up quicker. The chamber length L can hereby be reduced or the transport speed can be increased. For example, instead of an advance feed of 6 mm per revolution of the winding flyer 10 according to the invention, an advance feed of 8 mm or even 12 mm can be chosen.

The invention is particularly suitable for texturizing or heat setting of single or doubled carpet yarns, which can be of polyamid 6, polyamid 6.6, polyester, polypropylen or acrylic. It should be pointed out that the invention is not limited to such transport belts 4 to 7, which are arranged in polygonal form around a central mast 1; perforated wide transport belts can also be used, on which the yarns 8 are laid in wild or orderly loops.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for treating yarn comprising:

providing a heat setting chamber having a predetermined chamber length, heating said heat setting chamber with superheated steam, continuously supplying yarn in loops to a yarn conveyor, operating said yarn conveyor to continuously transport said yarn along a transport length through said heat setting chamber, controlling said heating to assure a constant yarn heat setting temperature along a part of said transport length in said heat setting chamber, said controlling heating including heating said heat setting chamber along said transport length to a predetermined temperature slightly higher than a predetermined required yarn heat setting temperature, and controlling the transport speed of the conveyor such that, after said yarn reaches the required yarn heat setting temperature along said transport path, said yarn is subjected to at least said required yarn heat setting temperature along said part of said transport length to thereby effect heat setting of said yarn.

2. A process according to claim 1, wherein the part area of the transport length with a constant temperature measures at least three quarters of the chamber length.

3. A process according to claim 2, wherein the predetermined temperature is set at a value which lies at a maximum of 10° C. over the heat setting temperature.

4. A process according to claim 3, wherein the controlling of the transport speed results in a dwell time for the yarn in the heat setting chamber lasts up to four minutes.

5. A process according to claim 2, wherein the controlling of the transport speed results in a dwell time for the yarn in the heat setting chamber lasts up to four minutes.

6. A process according to claim 1, wherein the predetermined temperature is set at a value which lies at a maximum of 10° C. over the heat setting temperature.

7. A process according to claim 6, wherein the controlling of the transport speed results in a dwell time for the yarn in the heat setting chamber lasts up to four minutes.

8. A process according to claim 1, wherein the controlling of the transport speed results in a dwell time for the yarn in the heat setting chamber lasts up to four minutes.

9. Apparatus for heat setting yarn comprising:

a heat setting chamber having an inlet opening and an exit opening and a predetermined length between said inlet and outlet opening, a continuously movable yarn conveyor for conveying yarn at a transport speed into the inlet opening, through the heat setting chamber along a transport length and out of the outlet opening, a steam heater for supplying steam heat to the heat setting chamber to maintain a part of the transport length at a constant predetermined temperature which is slightly higher than a predetermined required yarn setting temperature, and control means for controlling the transport speed of the conveyor such that, after said yarn reaches the required yarn heat setting temperature, said yarn is subjected to at least said required yarn heat setting temperature along said part of said transport length to thereby effect heat setting of said yarn.

10. Apparatus according to claim 9, wherein said constant predetermined temperature is set at less than 10° C. higher than the required yarn setting temperature.

11. Apparatus according to claim 9, wherein the heat setting chamber is open to surrounding atmosphere by way of exit and inlet openings for the yarn conveyor.

12. Apparatus according to claim 11, wherein fans are provided for blowing toward the respective exit and inlet opening.

13. Apparatus according to claim 11, wherein said constant predetermined temperature is set at less than 10° C. higher than required the yarn setting temperature.

14. A heat setting chamber for the continuous heat setting of yarn laid down in loops, said yarn being fed through a heat setting chamber with a predetermined chamber length and working with superheated steam, along a transport length with a predetermined transport speed, in which heat setting chamber a constant heat setting temperature which lies above the required heat setting temperature prevails along a part area of the transport length, wherein the chamber temperature is set at a value only slightly above the heat setting temperature and the transport speed and chamber length are so adjusted in relation to each other that the yarn, having reached the heat setting temperature, essentially retains the heat setting temperature along a part of the transport length, said heat setting chamber comprising:

entry openings and exit openings for transport belts carrying yarns, a feed pipe for backfeeding steam, a heating system for heating the steam, and a plurality of fans arranged beside each other in the direction of transport for generating a circulating current of steam directed transversely to the transport direction, wherein there are more than four fans, of which each of two fans arranged nearest to the entry openings and the exit openings have a rotational direction which is directed against the respective entry openings and exit openings.

15. A heat setting chamber according to claim 14, wherein the heat setting chamber comprises two single chambers which are connected to each other by a heated intermediary zone.

16. A heat setting chamber according to claim 15, wherein the single chambers are identically designed and are arranged symmetrically in relation to the intermediary zone.

* * * * *

UNITED STATES PATENT AND TRADEMARK OFFICE

CERTIFICATE OF CORRECTION

PATENT NO. : 5,557,862

DATED : September 24, 1996

INVENTOR(S) : Gerhard Vetter
Ludwig Resch

It is certified that error appears in the above-indentified patent and that said Letters Patent is hereby corrected as shown below:

Title page, item [73], Assignee: should read--

Michael Hörauf Maschinenfabrik GmbH & Co. KG,
Donzdorf, Germany--.

Signed and Sealed this

Twenty-third Day of December, 1997

Bruce Lehman

*Attest:*

BRUCE LEHMAN

*Attesting Officer*

*Commissioner of Patents and Trademarks*